US011796142B2

(12) United States Patent
Wang et al.

(10) Patent No.: US 11,796,142 B2
(45) Date of Patent: Oct. 24, 2023

(54) SPOT LAMP

(71) Applicants: SUZHOU OPPLE LIGHTING CO., LTD., Suzhou (CN); OPPLE LIGHTING CO., LTD., Shanghai (CN)

(72) Inventors: Yueping Wang, Suzhou (CN); Jingchun Zhang, Suzhou (CN); Shitao Deng, Suzhou (CN)

(73) Assignees: SUZHOU OPPLE LIGHTING CO., LTD., Suzhou (CN); OPPLE LIGHTING CO., LTD., Shanghai (CN)

( * ) Notice: Subject to any disclaimer, the term of this patent is extended or adjusted under 35 U.S.C. 154(b) by 0 days.

(21) Appl. No.: 17/537,162

(22) Filed: Nov. 29, 2021

(65) Prior Publication Data

US 2022/0082220 A1 Mar. 17, 2022

Related U.S. Application Data

(63) Continuation of application No. PCT/CN2020/092267, filed on May 26, 2020.

(51) Int. Cl.

| | |
|---|---|
| ***F21S 8/02*** | (2006.01) |
| ***F21V 17/10*** | (2006.01) |
| ***F21V 17/16*** | (2006.01) |

(52) U.S. Cl.

CPC ..... *F21S 8/02* (2013.01); *F21V 17/105* (2013.01); *F21V 17/16* (2013.01)

(58) Field of Classification Search

CPC ..... F21S 8/02; F21V 17/105; F21V 17/16

USPC ..... 362/365, 398, 148

See application file for complete search history.

(56) References Cited

U.S. PATENT DOCUMENTS

| | | | | |
|---|---|---|---|---|
| 8,801,217 | B2 | 8/2014 | Oehle et al. | |
| 8,905,584 | B2 * | 12/2014 | Maxik | F21V 5/04 362/386 |
| 2013/0051012 | A1 | 2/2013 | Oehle et al. | |
| 2018/0058671 | A1 * | 3/2018 | Cramer | F21V 17/105 |

(Continued)

FOREIGN PATENT DOCUMENTS

| | | | |
|---|---|---|---|
| CN | 102216683 | A | 10/2011 |
| CN | 102691949 | A | 9/2012 |
| CN | 102822591 | A | 12/2012 |

(Continued)

OTHER PUBLICATIONS

International Search Report of PCT Application No. PCT/CN2020/092267 dated Jul. 29, 2020 with English translation, (6p).

*Primary Examiner* — Laura K Tso
(74) *Attorney, Agent, or Firm* — Arch & Lake LLP

(57) ABSTRACT

A spot lamp, including a lamp body, a light source, a surface ring and a rotation connector, which is characterized in that the spot lamp includes a main body portion and an adjusting installation portion, which are separable from each other, the main body portion includes the lamp body, the light source and a first magnetic connection portion, and the adjusting installation portion includes the surface ring, the rotation connector and a second magnetic connection portion, the main body portion and the adjusting installation portion are connected by mutual attraction of the first magnetic connection portion and the second magnetic connection portion.

13 Claims, 3 Drawing Sheets

(56) References Cited

U.S. PATENT DOCUMENTS

2019/0390841 A1* 12/2019 Cadisch ..... F21V 17/12

FOREIGN PATENT DOCUMENTS

| | | | | | |
|---|---|---|---|---|---|
| CN | 206904882 | U | | 1/2018 | |
| CN | 207196254 | U | | 4/2018 | |
| CN | 208365351 | U | | 1/2019 | |
| CN | 210088638 | U | | 2/2020 | |
| DE | 202006016222 | U1 | | 1/2007 | |
| GB | 2540790 | A | * | 2/2017 | ..... F21S 8/02 |
| GB | 2578739 | A | * | 5/2020 | ..... F21S 8/02 |

* cited by examiner

SPOT LAMP

CROSS-REFERENCE TO RELATED APPLICATIONS

This application is based upon and claims the priority of PCT patent application No. PCT/CN2020/092267 filed on May 26, 2020 which claims priority to the Chinese patent application No. 201920807095.6 filed on May 31, 2019, the entire contents of which are hereby incorporated by reference herein for all purposes.

TECHNICAL FIELD

The present disclosure relates to a lighting lamp, in particular to a spot lamp.

BACKGROUND

A spot lamp refers to an embedded lighting lamp installed on the decorative ceiling, the spot lamp is installed on the ceiling through shrapnel or spring. Spot lamps are widely used in various indoor space places, such as home, hotel catering, commercial shops, supermarkets, experience halls, automobile 4S stores, venues, channels and various public space areas.

SUMMARY

This disclosure provide a spot lamp and a method of manufacturing a spot lamp.

According to a first aspect, a spot lamp is provided. The spot lamp may include a lamp body, a light source, a surface ring and a rotation connector. The spot lamp may include a main body portion and an adjusting installation portion, which may be separable from each other, the main body portion may include the lamp body, the light source and a first magnetic connection portion, and the adjusting installation portion may include the surface ring, the rotation connector and a second magnetic connection portion, the main body portion and the adjusting installation portion may be connected by mutual attraction of the first magnetic connection portion and the second magnetic connection portion.

According to a second aspect, a method of manufacturing a spot lamp is provided. The method may include providing the spot lamp with a lamp body, a light source, a surface ring and a rotation connector; providing the spot lamp with a main body portion and an adjusting installation portion, wherein the main body portion and the adjusting installation portion are separable from each other, providing the main body portion with the lamp body, the light source and a first magnetic connection portion, providing the adjusting installation portion with the surface ring, the rotation connector and a second magnetic connection portion, and connecting the main body portion and the adjusting installation portion by mutual attraction of the first magnetic connection portion and the second magnetic connection portion.

It is to be understood that both the foregoing general description and the following detailed description are exemplary and explanatory only and are not restrictive of the present disclosure.

DETAILED DESCRIPTION

Hereinafter, the spot lamp proposed in the present disclosure is further described in detail in combination with the accompanying drawings and specific examples.

Sometimes, spot lamp assembly mostly uses fastening components such as screws to fix and assemble portions. After assembly, it is a non-detachable and integrated spot lamp. However, as a key lighting lamp, the requirements for its light angle and direction are different in different occasions. In order to meet different requirements, different light distribution elements are usually required. Therefore, the integrated spot lamp has the problems that the lens, secondary reflector and other portions are not easy to replace, difficult to disassemble and poor universality.

Figure 1:
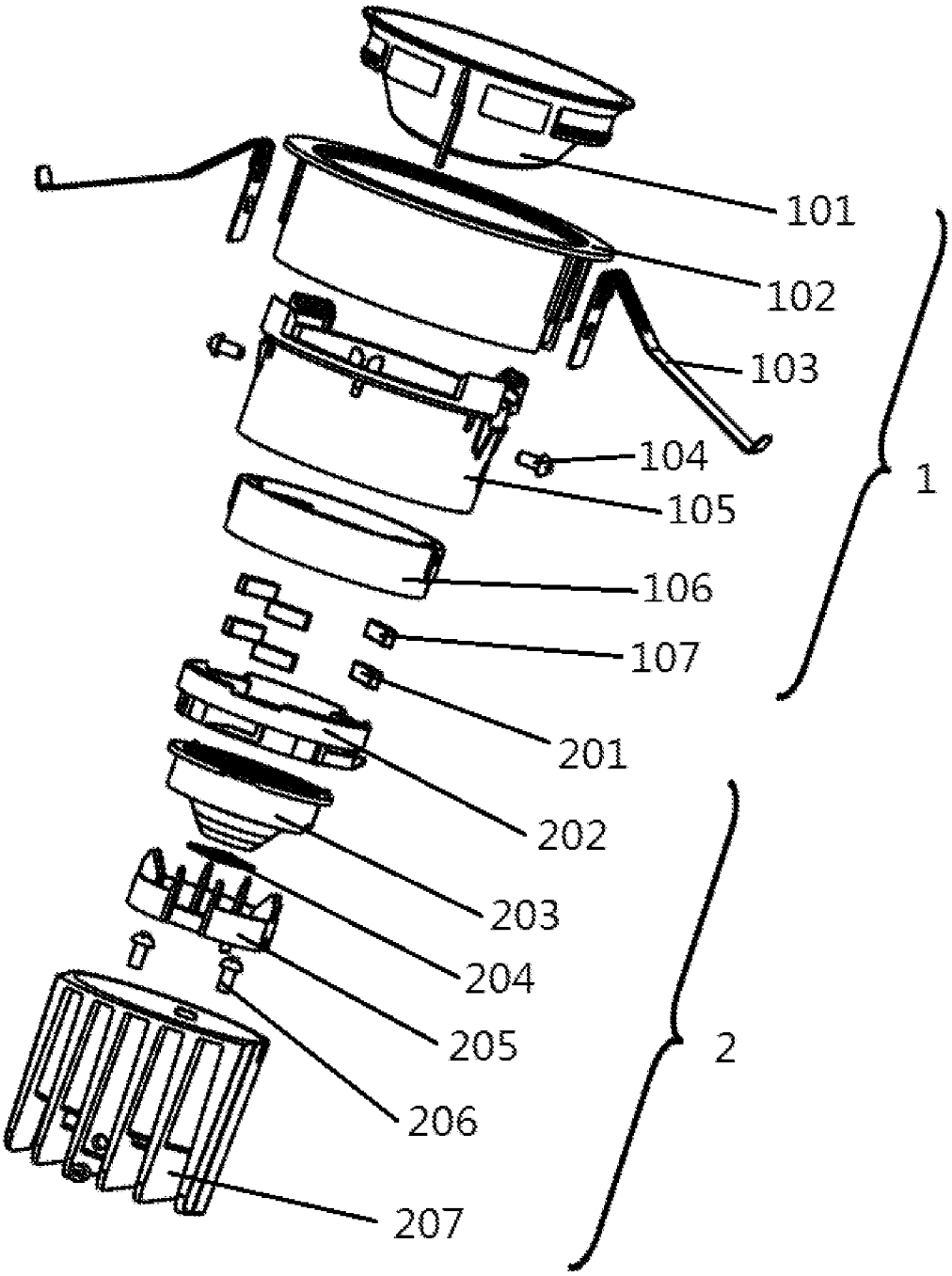
FIG. 1 is a structural decomposition diagram of an example of the present disclosure.

As illustrated by FIG. 1, a spot lamp of an example provided by the present disclosure includes a main body portion 2 and an adjusting installation portion 1.

The main body portion 2 includes a lamp body 207 with an accommodating space 2078. In the present example, the light source 204, the light source support 205 and the lens 203 are arranged in the accommodating space 2078 of the lamp body 207, the light source 204 is arranged on the light source support 205, and the light source support 205 is fixed at the bottom of the lamp body 207 by screws 206. One end of the lamp body 207 is provided with a lower end cover 202, one end of the lens 203 is abutted against an inner bottom of the lamp body 207, and the other end is abutted against the lower end cover 202. During installation, the light source support 205, the light source 204 and the lens 203 are installed into the lamp body 207 in order, and a port is covered by the lower end cover 202. The assembly of the main body portion 2 is completed. In the present example, the lamp body 207 acts as the shell and radiator of the spot lamp at the same time. Therefore, an outer surface of the lamp body 207 is also provided with heat dissipation fins. In other examples, the outer surface of the lamp body can also be a smooth surface or another radiator is provided. In the present example, the light source 204 is a COB light source, which is installed on the light source support 205. In other examples, the light source 204 can also be a light source board provided with LEDs, and the light source board can be directly fixed at the bottom of the lamp body 207 through screws. This disclosure is not limited thereto.

Figure 2:
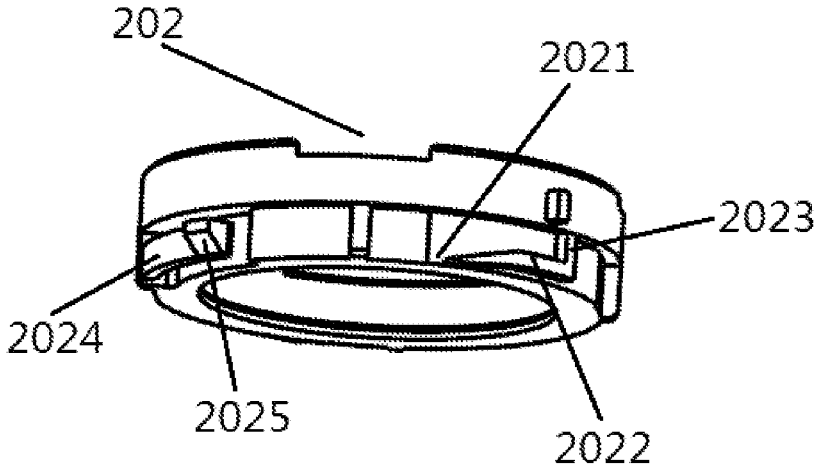
FIG. 2 is a structural diagram of a lower end cover in an example of the present disclosure.
Figure 3:
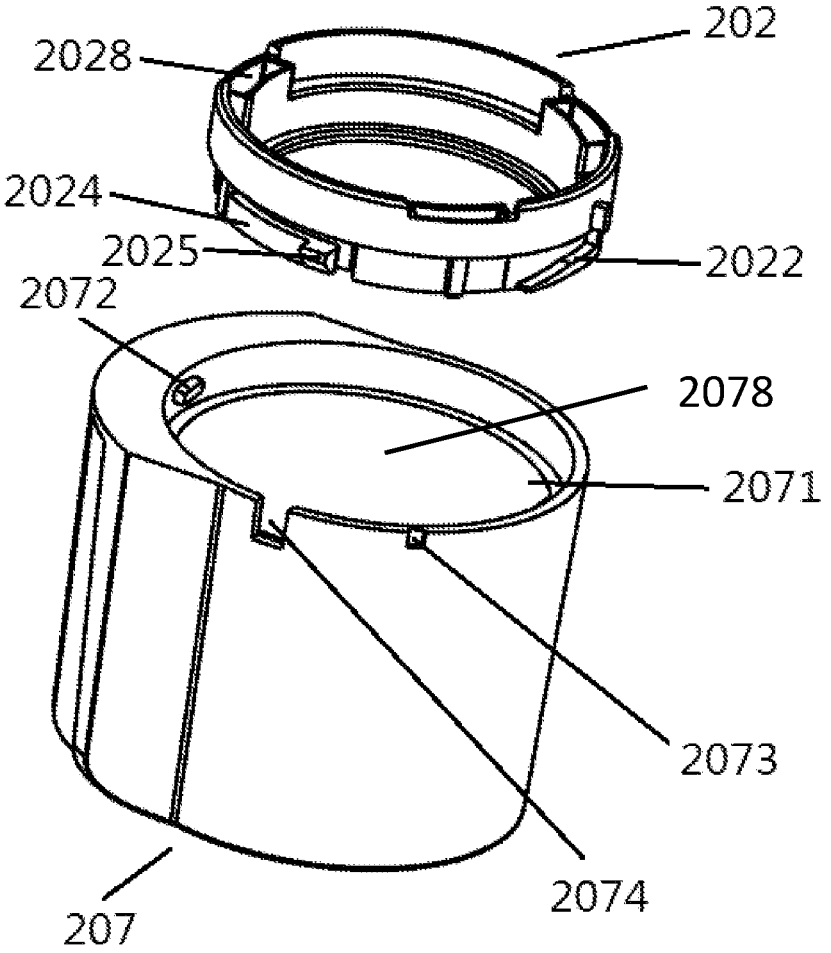
FIG. 3 is a structural diagram of a matching relationship between a lower end cover and a lamp body in an example of the present disclosure.

We will explain the connection mode between the lower end cover 202 and the lamp body 207 in detail in the present example through FIGS. 2 and 3. As illustrated by FIG. 3, the lamp body 207 forms an accommodating space 2078 with an opening 2071, and the lower end cover 202 covers the opening 2071. A convex block 2072 is arranged on the inner sidewall at the opening 2071 of the lamp body 207. As illustrated by the figure, the lower end cover 202 has a ring shape, and a latching portion 2022 is arranged on an outer sidewall of the lower end cover 202, protrudes from the outer sidewall and extends in the circumferential direction.

The front of one end of the latching portion 2022 is a convex block inlet 2021, a guide inclined plane is arranged on a side of the latching portion 2022 close to the convex block inlet 2021, and a limiting portion 2023 is arranged on the other end and also protrudes from the outer sidewall and extends in an axial direction. Upon the lower end cover 202 being connected with the lamp body 207, the lower end cover 202 extends into the opening 2071 of the lamp body 207, and the convex block 2072 moves radially at the convex block inlet 2021. At this time, the convex block 2072 and the latching portion 2022 are not overlapped radially. Then, rotate the lower end cover 202, and the convex block 2072 moves above the latching portion 2022 in the circumferential direction until it is limited by the limiting portion 2023 and cannot move forward. This time, the convex block 2072 and the latching portion 2022 are overlapped radially, and the lower end cover 202 cannot be separated from the lamp body 207, and the connection between the lower end cover 202 and the lamp body 207 is completed. In order to make the connection reliable, we generally need to set more than two convex blocks 2072 and latching portions 2022, which are arranged in pairs, and the convex blocks and the latching portions are arranged in pairs and evenly arranged along the circumferential direction.

In the above structure, although the limiting portion 2023 restricts the forward movement of the convex block 2072, it cannot restrict its retreat. Therefore, the lower end cover 202 of the present example is also provided with an elastic arm 2024, which extends along the circumferential direction to form an arc section coaxial with the lower end cover 202. One end is connected with the lower end cover 202, the other end is a free end, and a gap is left between the free end and the lower end cover 202. The free end is provided with a convex point 2025 protruding outward along the radial direction. The lamp body 207 is provided with a slot 2074 that can accommodate the convex point 2025. After the lower end cover 202 and the lamp body 207 are connected and fixed, the convex point 2025 is located in the slot 2074. The lamp body 207 is also provided with a positioning mark 2073. Upon the convex point 2025 being aligned with the positioning mark 2073, the convex block 2072 is located at the convex block inlet 2021 of the latching portion 2022. Upon the convex point 2025 being turned to the position where the slot 2074 is located, the convex block 2072 is located above the latching portion 2022 and is overlapped radially with the latching portion 2022. During installation, just align the convex point 2025 on the elastic arm 2024 with the positioning mark 2073 on the lamp body 207, and right rotate the lower end cover 202 to clamp the convex point 2025 at the position where the slot 2074 of the lamp body 207 is located. At this time, the lower end cover cannot continue to rotate. During disassembly, just press the convex point 2025 on the elastic arm 2024 inward and left rotate the lower end cover 202 to complete the disassembly of the lower end cover 202. The structure is convenient and fast to realize the rapid replacement of the lens.

Figure 4:
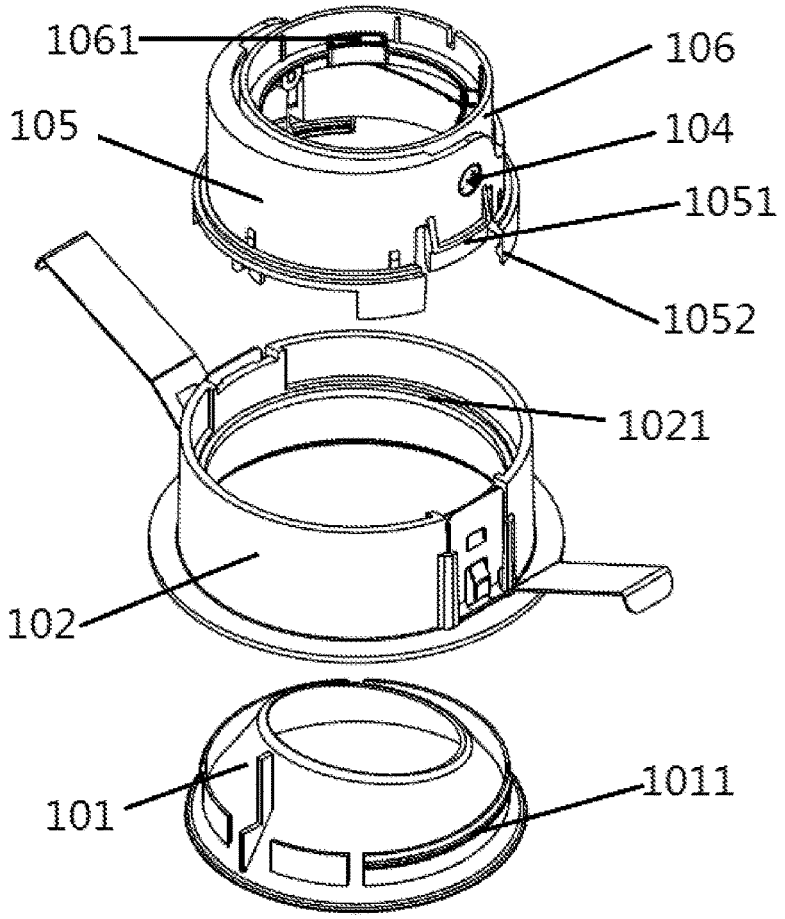
FIG. 4 is a structural decomposition diagram of an adjusting installation portion in an example of the present disclosure.

As illustrated by FIG. 4, the adjusting installation portion 1 includes a reflector 101, a surface ring 102, a rotation connector 105 and an upper end cover 106. The main function of the surface ring 102 is to install and fix the lamp. In the present example, the surface ring 102 is provided with a shrapnel 103, and the surface ring 102 is installed in the opening of the installation surface through the shrapnel 103. In other examples, the surface ring can also be provided with springs, supports and other installation structures. The light output of the spot lamp is generally directional. Due to different irradiation positions, it is necessary to adjust the lamp itself or the light distribution device, and the surface ring 102 cannot act after being installed on the ceiling. Therefore, a connector is usually set between the surface ring 102 and the lamp, so that the light source or light distribution device can rotate and move relative to the surface ring 102. In the present example, the rotation connector 105 is provided, which is in snap-fit connection with the surface ring 102 and can rotate coaxially relative to the surface ring 102. In other examples, the rotation connector 105 and the surface ring 102 can also be connected to their sidewalls by screws, with the screw as the rotating shaft, and the direction of the rotating shaft is parallel to the installation surface. In the present example, the reflector 101, as a secondary optical device of the spot lamp, is a polarized reflector, which is in snap-fit connection with the rotation connector 105. Upon the reflector 101 being rotated with the rotation connector 105, the irradiation direction of the spot lamp can be changed.

Figure 5:
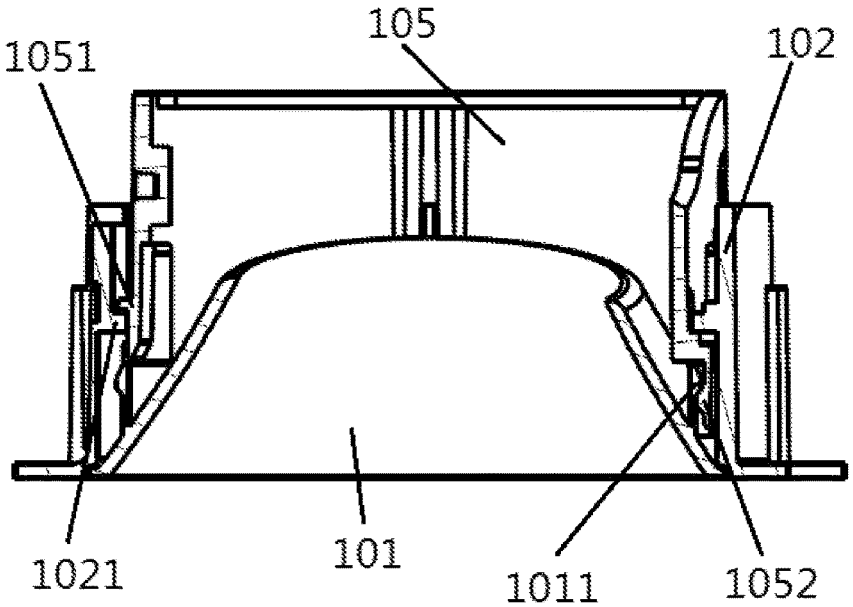
FIG. 5 is a sectional structure diagram after a reflector, a surface ring and a rotation connector are assembled in an example of the present disclosure.

In the present example, the specific connection mode of the reflector 101, the surface ring 102 and the rotation connector 105 is shown in FIG. 4 and FIG. 5. The rotation connector 105 is provided with a claw 1051, and the inner sidewall of the surface ring 102 is provided with a first clamping portion 1021. After clamping, the claw 1051 and the clamping portion 1021 can rotate in the circumferential direction. The rotation connector 105 is also provided with a hook 1052, and the reflector 101 is provided with a matched second clamping portion 1011. During installation, the hook 1052 is clamped with the second clamping portion 1011.

Through the above introduction, we can find that the spot lamp of the present example is divided into the main body portion 2 including the light source and the adjusting installation portion 1 as the installation and adjustment of the light output direction. The main body portion and the adjusting installation portion are separated from each other, and they need to be connected as a whole to serve as a lamp. In order to enable the main body portion 2 to be flexibly assembled with different types of installation surface rings or secondary optical devices, in the present example, the main body portion 2 and the adjusting installation portion 1 are magnetically connected, so the two portions can be easily separated and combined. Specifically, the main body portion 2 includes a first magnetic connection portion 201, the adjusting installation portion 1 includes a second magnetic connection portion 107, and the main body portion 2 and the adjusting installation portion 1 are connected by mutual attraction of the first magnetic connecting portion 201 and the second magnetic connecting portion 107. In the main body portion 2, the first magnetic connection portion 201 is arranged on the lower end cover 202, and a corresponding component is required in the adjusting installation portion 1. Therefore, the adjusting installation portion 1 also includes an upper end cover 106, and the second magnetic connection portion 107 is arranged on the upper end cover. During connection, the upper end cover 106 and the lower end cover 202 can be aligned and pulled in. In the present example, the upper end cover 106 is installed on the rotation connector 105 through the screw 104. Upon the irradiation angle being needed to be adjusted, the main body portion 2 rotates with the rotation connector 105. In other examples, the upper end cover 106 may also be arranged on the surface ring 102, so that upon the irradiation angle being adjusted, only the rotation connector 105 and the reflector 101 rotate, while the light source portion does not move.

The first magnetic connection portion 201 includes a plurality of first magnets, and the second magnetic connection portion 107 includes a plurality of second magnets. The first magnets and the second magnets are arranged in pairs. In the present example, the first magnets and the second magnets are permanent magnets, and the magnetism of the opposite sides of the first magnet and the second magnet are opposite. In other examples, one of the first magnet and the second magnet can also be a permanent magnet, and the other of the first magnet and the second magnet can be a magnetic material that can be adsorbed by the permanent magnet, such as metal materials such as iron. The number of the first magnets and the second magnets is preferably more than two, and three in the present example. Three pairs of magnets are arranged at different positions to enhance stability. In the present example, the upper end cover 106 and the lower end cover 201 have ring shapes, so the three pairs of magnets are evenly arranged along the circumferential direction. The upper end cover 106 is provided with a magnet accommodating groove 1061, the lower end cover 202 is provided with a magnet accommodating groove 2028, and the first magnet and the second magnet are respectively arranged in the magnet accommodating grooves 2028 and 1061 through adhesive dispense. In other examples, the first magnet and the second magnet can also be fixed by interference inserting into the magnet accommodating slots 2028 and 1061.

A technical solution adopted by the present disclosure provides a spot lamp, which includes a lamp body, a light source, a surface ring and a rotation connector, which is characterized in that the spot lamp includes a main body portion and an adjusting installation portion, which are separable from each other, the main body portion includes the lamp body, the light source and a first magnetic connection portion, and the adjusting installation portion includes the surface ring, the rotation connector and a second magnetic connection portion, the main body portion and the adjusting installation portion are connected by mutual attraction of the first magnetic connection portion and the second magnetic connection portion.

Preferably, the main body portion further includes a lower end cover, the lamp body forms a accommodating space with an opening, the light source is arranged in the accommodating space, the lower end cover is arranged at the opening of the accommodating space, and, the first magnetic connection portion is arranged on the lower end cover;

the adjusting installation portion further includes an upper end cover, the upper end cover is fixedly connected with the surface ring or the rotation connector, and the second magnetic connection portion is arranged on the upper end cover.

Preferably, a convex block is arranged on an inner sidewall at the opening of the lamp body, the lower end cover has a ring shape, a latching portion is arranged on an outer sidewall of the lower end cover and protrudes from the outer sidewall and extends in a circumferential direction, a convex block inlet is arranged in front of one end of the latching portion, a limiting portion is arranged on the other end of the latching portion and protrudes from the outer sidewall and extends in an axial direction, and the convex block and the latching portion are overlapped radially upon the lamp body being connected with the lower end cover.

Preferably, a number of the convex block and a number of the latching portion are both more than two, and the convex block and the latching portion are arranged in pairs and evenly arranged in the circumferential direction.

Preferably, an elastic arm is arranged on the lower end cover, the elastic arm is an arc section coaxial with the lower end cover, one end of the elastic arm is a free end, the other end of the elastic arm is connected with the lower end cover, a gap is provided between the free end and the lower end cover, a convex point is arranged on the free end and protrudes outward along a radial direction, a slot is arranged on the lamp body, and, the convex point is accommodated in the slot, after the lower end cover being connected and fixed with the lamp body.

Preferably, a positioning mark is further arranged on the lamp body, upon the convex point being aligned with the positioning mark, the convex block and the latching portion are not overlapped radially, and, upon the convex point being located in the slot, the convex block and the latching portion are overlapped radially.

Preferably, the spot lamp further includes a lens, one end of the lens is abutted against an inner bottom of the lamp body, and, the other end of the lens is abutted against the lower end cover.

Preferably, the surface ring and the rotation connector are connected through a snap-fit connection.

Preferably, the spot lamp further includes a reflector, and the reflector and the rotation connector are connected through a snap-fit connection.

Preferably, the first magnetic connection portion includes at least two first magnets, the second magnetic connection portion includes at least two second magnets, one second magnet of the at least two second magnets is arranged corresponding to one first magnet of the at least two first magnets, and, the first magnet and the second magnet are permanent magnets, two opposite sides of the second magnet and the first magnet have opposite magnetism, or, one of the first magnet and the second magnet is a permanent magnet, and the other of the first magnet and the second magnet is a magnetic material that can be adsorbed by the permanent magnet.

Preferably, the upper end cover and the lower end cover both have ring shapes, and, the at least two first magnets and the at least two second magnets are evenly arranged in a circumferential direction.

Preferably, a plurality of accommodating grooves are arranged on the upper end cover and/or the lower end cover, and, the at least two first magnets and the at least two second magnets are fixed in the plurality of accommodating grooves.

The spot lamp described in the disclosure adopts a completely modular design, and the main portion and the adjusting installation portion are separated from each other, which can realize the rapid replacement of secondary reflector and other components and installation rings, so as to meet different requirements of light distribution and installation. The application of magnetic absorption principle also gives customers a good feel of quick disassembly. The design of the lower end cover can realize the rapid replacement of the lens, and solve the problems of difficult replacement and disassembly of traditional spot lamp lens, secondary reflector and other portions.

The present disclosure provides a method of manufacturing a spot lamp. The method may include providing the spot lamp with a lamp body, a light source, a surface ring and a rotation connector; providing the spot lamp with a main body portion and an adjusting installation portion, wherein the main body portion and the adjusting installation portion are separable from each other, providing the main body portion with the lamp body, the light source and a first magnetic connection portion, providing the adjusting installation portion with the surface ring, the rotation connector and a second magnetic connection portion, and connecting the main body portion and the adjusting installation portion by mutual attraction of the first magnetic connection portion and the second magnetic connection portion.

The method may also include providing the main body portion with a lower end cover, forming an accommodating space with an opening on the lamp body, arranging the light source in the accommodating space, arranging the lower end cover at the opening of the accommodating space, arranging the first magnetic connection portion on the lower end cover, providing the adjusting installation portion with an upper end cover, fixedly connecting the upper end cover with the surface ring or the rotation connector, and arranging the second magnetic connection portion on the upper end cover.

The above description of the examples of the present disclosure is for illustration and description, and is not intended to exhaust or limit the disclosure to the specific forms disclosed. Obviously, many modifications and changes may be made, which may be obvious to those skilled in the art and should be included in the scope of the disclosure.

What is claimed is:

1. A spot lamp, comprising:

a main body portion and an adjusting installation portion, wherein the main body and the adjusting installation portion are separable from each other and are connected by mutual attraction, the main body portion comprises a lamp body, a light source and a first magnetic connection portion, the light source is arranged inside the lamp body, the adjusting installation portion comprises a surface ring, a rotation connector and a second magnetic connection portion, the rotation connector is in snap-fit connection with the surface ring, and the main body portion and the adjusting installation portion are connected by mutual attraction of the first magnetic connection portion and the second magnetic connection portion.

2. The spot lamp according to claim 1, wherein:

the main body portion further comprises a lower end cover, the lamp body forms an accommodating space with an opening, the light source is arranged in the accommodating space, the lower end cover is arranged at the opening of the accommodating space, and, the first magnetic connection portion is arranged on the lower end cover; and the adjusting installation portion further comprises an upper end cover, the upper end cover is fixedly connected with the surface ring or the rotation connector, and the second magnetic connection portion is arranged on the upper end cover.

3. The spot lamp according to claim 2, wherein a convex block is arranged on an inner sidewall at the opening of the lamp body, the lower end cover has a ring shape, a latching portion is arranged on an outer sidewall of the lower end cover and protrudes from the outer sidewall and extends in a circumferential direction, a convex block inlet is arranged in front of one end of the latching portion, a limiting portion is arranged on the other end of the latching portion and protrudes from the outer sidewall and extends in an axial direction, and the convex block and the latching portion are overlapped radially upon the lamp body being connected with the lower end cover.

4. The spot lamp according to claim 3, wherein the convex block and the latching portion are arranged in pairs and evenly arranged in the circumferential direction, and more than two pairs of the convex block and the latching portion are provided.

5. The spot lamp according to claim 4, wherein an elastic arm is arranged on the lower end cover, the elastic arm is an arc section coaxial with the lower end cover, one end of the elastic arm is a free end, the other end of the elastic arm is connected with the lower end cover, a gap is provided between the free end and the lower end cover, a convex point is arranged on the free end and protrudes outward along a radial direction, a slot is arranged on the lamp body, and, the convex point is accommodated in the slot, after the lower end cover being connected and fixed with the lamp body.

6. The spot lamp according to claim 5, wherein a positioning mark is further arranged on the lamp body, upon the convex point being aligned with the positioning mark, the convex block and the latching portion are not overlapped radially, and, upon the convex point being located in the slot, the convex block and the latching portion are overlapped radially.

7. The spot lamp according to claim 2, wherein the spot lamp further comprises a lens, one end of the lens is abutted against the lamp body, and, the other end of the lens is abutted against the lower end cover.

8. The spot lamp according to claim 1, wherein the spot lamp further comprises a reflector, and the reflector and the rotation connector are connected through a snap-fit connection.

9. The spot lamp according to claim 2, wherein the first magnetic connection portion comprises at least two first magnets, the second magnetic connection portion comprises at least two second magnets, one second magnet of the at least two second magnets is arranged corresponding to one first magnet of the at least two first magnets, wherein:

all of the at least two first magnets and the at least two second magnets are permanent magnets, two opposite sides of the at least two second magnets and the at least two first magnets have opposite magnetism, or the at least two first magnets are permanent magnets, and the at least two second magnets are magnetic material that is adsorbed by the permanent magnets, or the at least two second magnets are permanent magnets, and the at least two first magnets are magnetic material that is adsorbed by the permanent magnets.

10. The spot lamp according to claim 9, wherein the upper end cover and the lower end cover both have ring shapes, and, the at least two first magnets and the at least two second magnets are evenly arranged in a circumferential direction.

11. The spot lamp according to claim 10, wherein a plurality of accommodating grooves are arranged on the upper end cover or the lower end cover, and, the at least two first magnets and the at least two second magnets are fixed in the plurality of accommodating grooves.

12. A method of manufacturing a spot lamp, comprising:

providing the spot lamp with a main body portion and an adjusting installation portion, wherein the main body portion and the adjusting installation portion are separable from each other and are connected by mutual attraction, providing the main body portion with a lamp body, a light source and a first magnetic connection portion, wherein the light source is arranged inside the lamp body, providing the adjusting installation portion with a surface ring, a rotation connector and a second magnetic connection portion, wherein the rotation connector is in snap-fit connection with the surface ring, and connecting the main body portion and the adjusting installation portion by mutual attraction of the first magnetic connection portion and the second magnetic connection portion.

13. The method of claim 12, further comprising:

providing the main body portion with a lower end cover, forming an accommodating space with an opening on the lamp body, arranging the light source in the accommodating space, arranging the lower end cover at the opening of the accommodating space, arranging the first magnetic connection portion on the lower end cover, providing the adjusting installation portion with an upper end cover, fixedly connecting the upper end cover with the surface ring or the rotation connector, and arranging the second magnetic connection portion on the upper end cover.

* * * * *